US005618239A

United States Patent [19]

Rife

[11] Patent Number: 5,618,239

[45] Date of Patent: Apr. 8, 1997

[54] GROOVE CONFIGURATION FOR A GOLF CLUB

[76] Inventor: Guerin D. Rife, 1230 Via Salerno, Winter Park, Fla. 32789

[21] Appl. No.: 601,861

[22] Filed: Feb. 15, 1996

[51] Int. Cl.[6] ..... A63B 53/04

[52] U.S. Cl. ..... 473/330; 473/331

[58] Field of Search ..... 473/330, 331, 473/251, 254, 342

[56] References Cited

U.S. PATENT DOCUMENTS

| | | | |
|---|---|---|---|
| 732,136 | 6/1903 | Taylor | 473/331 |
| 1,188,479 | 6/1916 | Park | 473/331 |
| 1,289,553 | 12/1918 | Sanders | 473/331 |
| 1,337,958 | 4/1920 | Reach | 473/331 |
| 3,869,126 | 3/1975 | Thompson | 473/331 |
| 4,792,140 | 12/1988 | Yamaguchi | 473/331 |
| 5,029,864 | 7/1991 | Keener . | |
| 5,090,702 | 2/1992 | Viste | 473/331 |
| 5,348,301 | 9/1994 | Ma | 473/331 |

*Primary Examiner*—Sebastiano Passaniti
*Attorney, Agent, or Firm*—Aquilino & Welsh

[57] ABSTRACT

A groove configuration for a putter type golf club head formed of a series of grooves. Each groove has a first surface disposed at an angle no greater than 90 degrees to the ball striking face and a second surface disposed at a lesser angle to the ball striking face. The outermost edges of the groove surfaces intersect in a saw-tooth configuration to provide a gripping area which imparts spin to a golf ball when it is struck by the putter type golf club.

15 Claims, 4 Drawing Sheets

GROOVE CONFIGURATION FOR A GOLF CLUB

BACKGROUND AND SUMMARY OF THE INVENTION

The present invention relates to putter type golf clubs and in particular to putters having an improved groove configuration on the ball striking face.

Most putters are provided with a smooth ball striking face, without grooves, with greater or lesser degree of loft in order to control the distance and direction that the golf ball travels. Other conventional golf clubs, such as irons and woods, use a pattern of U-shaped or V-shaped grooves. The U-shaped grooves have two opposing surfaces each at 90 degrees to the ball striking face. The V-shaped grooves have one surface at an angle less than 90 degrees and a second surface at an angle greater than 90 degrees. U.S. Pat. No. 5,029,864 to Keener relates to a groove configuration for an iron type golf club using V-shaped grooves having a normal and a contact face to provide improved backspin.

The present invention relates to putters having an improved groove configuration etched, molded or forged laterally across the ball striking surface. Unlike the U-shaped or U-shaped grooves mentioned above, the groove configuration of the present invention has a first surface at an angle up to but not greater than 90 degrees to the ball striking face and a second surface extending downwardly and inwardly from the outer edge of the first surface at a lesser acute angle forming an upward saw-tooth configuration. A preferable groove configuration has a first surface at 90 degrees, or perpendicular to the ball striking face and a second surface at an angle of approximately 30 degrees. The sharp edges of the two angularly disposed surfaces form a gripping area which imparts spin to a golf ball struck by a golf club having the groove pattern. The groove configuration is particularly useful on a putter type golf club and the gripping effect as the putter face comes in contact with the surface of the ball causes a lifting action which creates overspin causing the ball to track along the ground on the line on which it was struck.

In preferred embodiments, the grooves are positioned on either side of the center of percussion and preferably run laterally across the entire width of the putter face in a heel to toe direction. Because of the gripping action of the grooves, a ball struck off center has the same overspin or tracking as if it were hit in the center of the putter face. This expanded area provides improved roll off the face and greatly reduces mis-hits thereby improving a golfer's proficiency.

The groove configuration of the present invention creates an increased gripping action on the ball and eliminates the need for different putter face lofts making a single putter adaptable to any putting surface. With a conventional putter, where grooves are not present, the loft of the ball striking face must increase to create the needed lift and overspin on the ball. On slow greens with longer grasses, a golfer must strike a ball harder to obtain the necessary roll. The improved grooves create more lift thereby getting the ball on top of the grass and, therefore, on slower greens the ball need not be struck with as much force to produce the same roll.

Among the objects of the present invention are the provision of a putter type golf club having an improved groove configuration to impart more control to a golf ball when it is struck toward a target.

Another object is the provision of a groove configuration which eliminates the need for different lofted putter faces to accommodate different putting surface conditions.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

Figure 1:
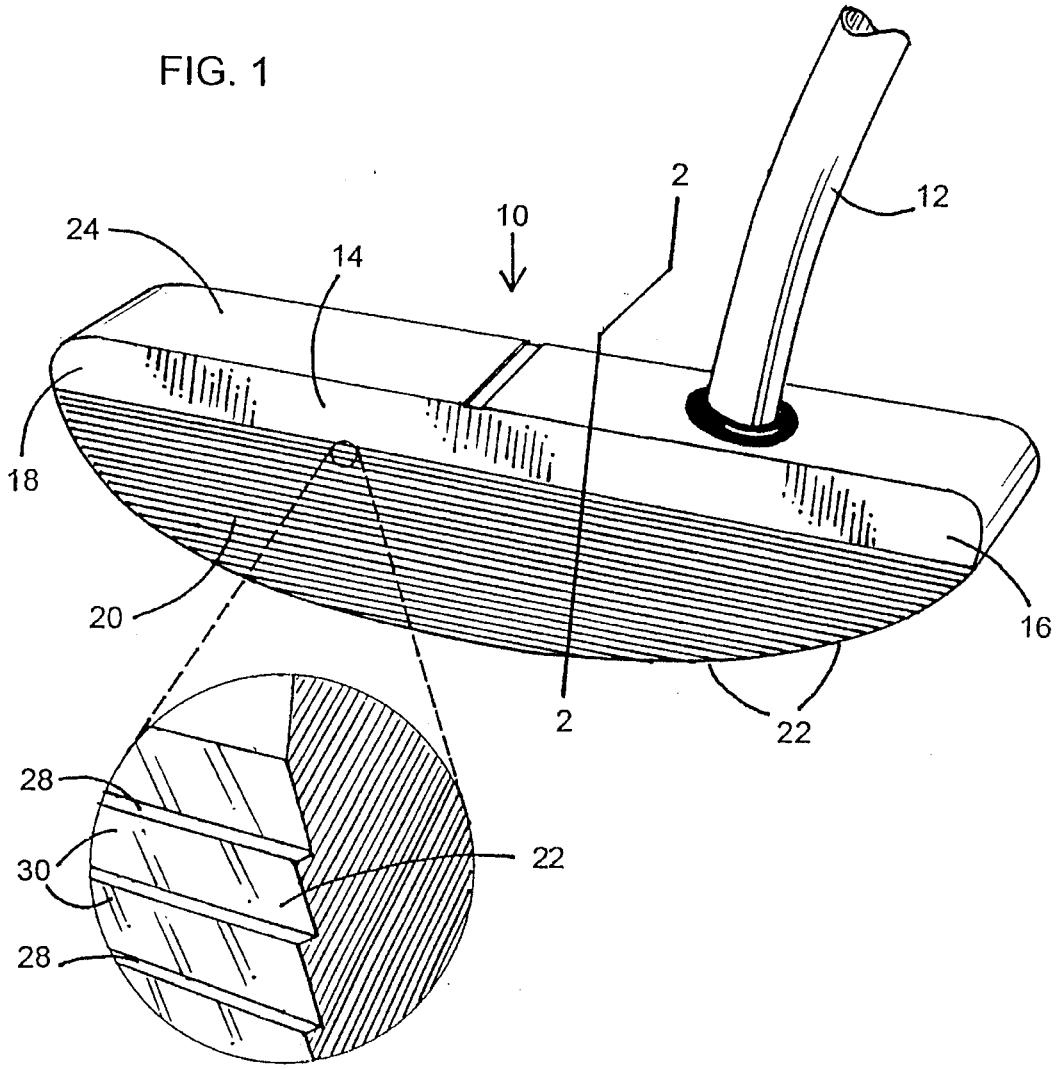
FIG. 1 is a front perspective view of a putter type club using a groove configuration in accordance with the present invention including an exploded and enlarged section of several grooves.
Figure 2:
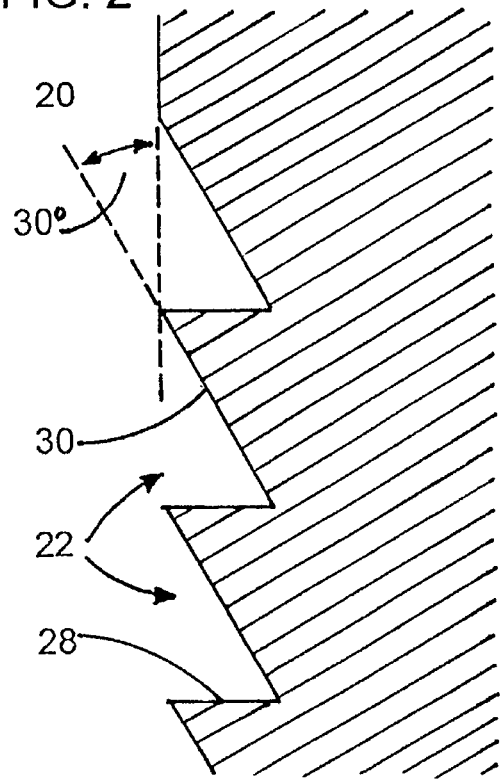
FIG. 2 is a sectional view of the putter type club taken along lines 2—2 of FIG. 1.

FIGS. 1 and 2 illustrate a putter type golf club head 10 having a shaft 12, club head body 14 including a heel 16, toe 18 and ball striking face 20. A series of grooves 22 are formed in the ball striking face 20 in a heel 16 to toe 18 direction, each of the grooves 22 being the same size and being parallel to each other. In the preferred embodiment shown, the grooves 22 extend partway between the upper surface 24 and the leading edge 26 of the club head 10. Alternately, the grooves 22 may extend the total height of the ball striking face 20.

As seen in the enlarged, exploded portion of FIG. 1 and the sectional view of FIG. 2, a preferred groove configuration includes a series of grooves 22 which are each formed by a first surface 28 formed at 90 degrees or perpendicular to the ball striking face 22 and extending into the same and a second angular surface 30, extending downwardly and inwardly from the outermost point of the first surface 28. Preferably, the angular surface 30 is formed in the club head body 14 at an angle of approximately thirty degrees although greater or lesser surface angles are equally applicable. The intersection of the surfaces forms a repetitive, saw-tooth array of grooves 22. The outer edges of the first surface 28 and the second surface 30 interface to form a gripping edge 32 which imparts spin to a golf ball when it is struck by the golf club of the present invention.

Figure 3:
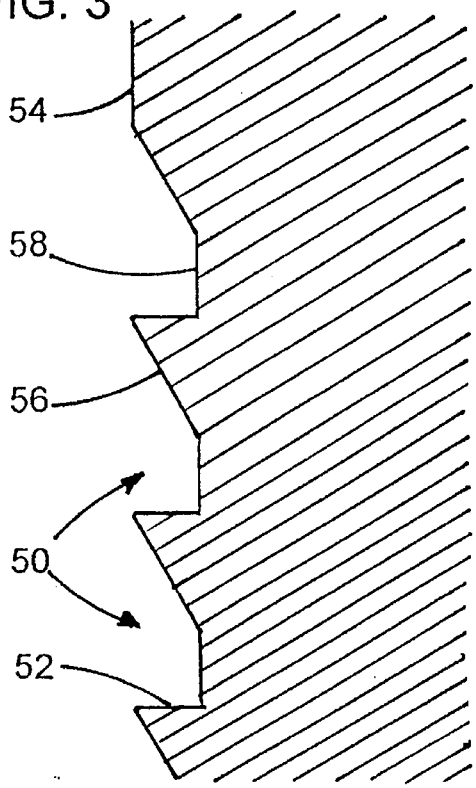
FIG. 3 is a sectional view of a putter type golf club with an alternate groove configuration.

FIG. 3 shows a sectional view of a second groove configuration in accordance with the present invention. A series of grooves 50 are formed with a first surface 52 perpendicular or 90 degrees to the ball striking face 54 and a second angular surface 56 which extends downwardly and inwardly and interfaces with an intermediate flat area 58 which separates each of the grooves 50.

Figure 4:
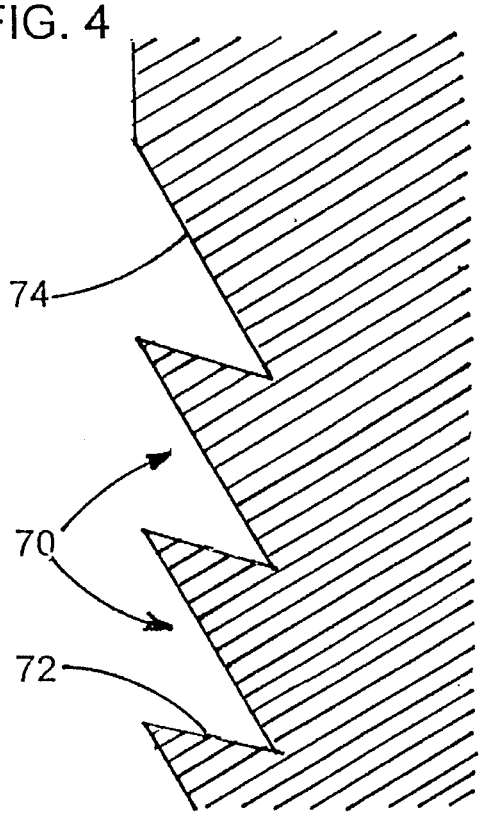
FIG. 4 is a sectional view of a putter type golf club with another alternate groove configuration.

FIG. 4 shows still another groove configuration in the form of a series of grooves 70 having a first surface 72 at an acute angle less than 90 degrees and a second surface 74 formed at a lesser angle. Typically, the angle of the first surface 72 would be approximately 60 degrees while the angle of the second surface 74 would be approximately 30 degrees.

Figure 5:
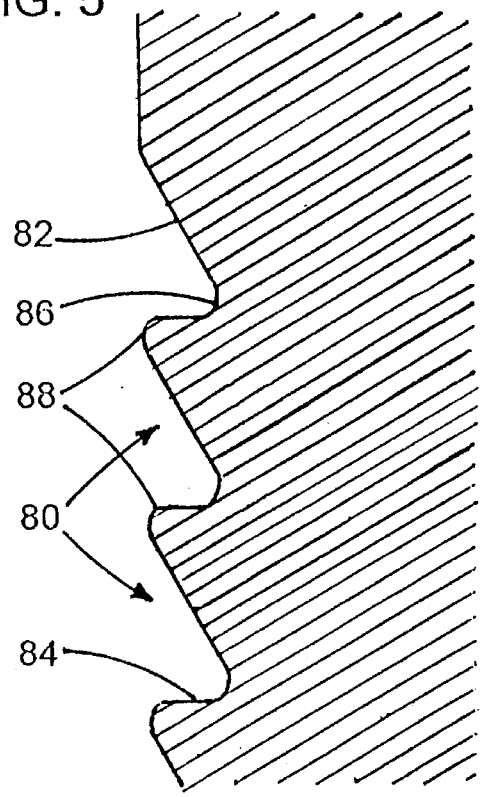
FIG. 5 is a sectional view of still another putter type golf club having an alternate groove pattern.

FIG. 5 shows another groove configuration in the form of a series of grooves 80 having angular surfaces 82 and 84 which interface at the outer edges and inner bottoms of the grooves 80. The grooves 80 are formed with a rounded bottom 86 and a rounded outer edge 88 at the respective interfaces of the surfaces 82 and 84.

Figure 6:
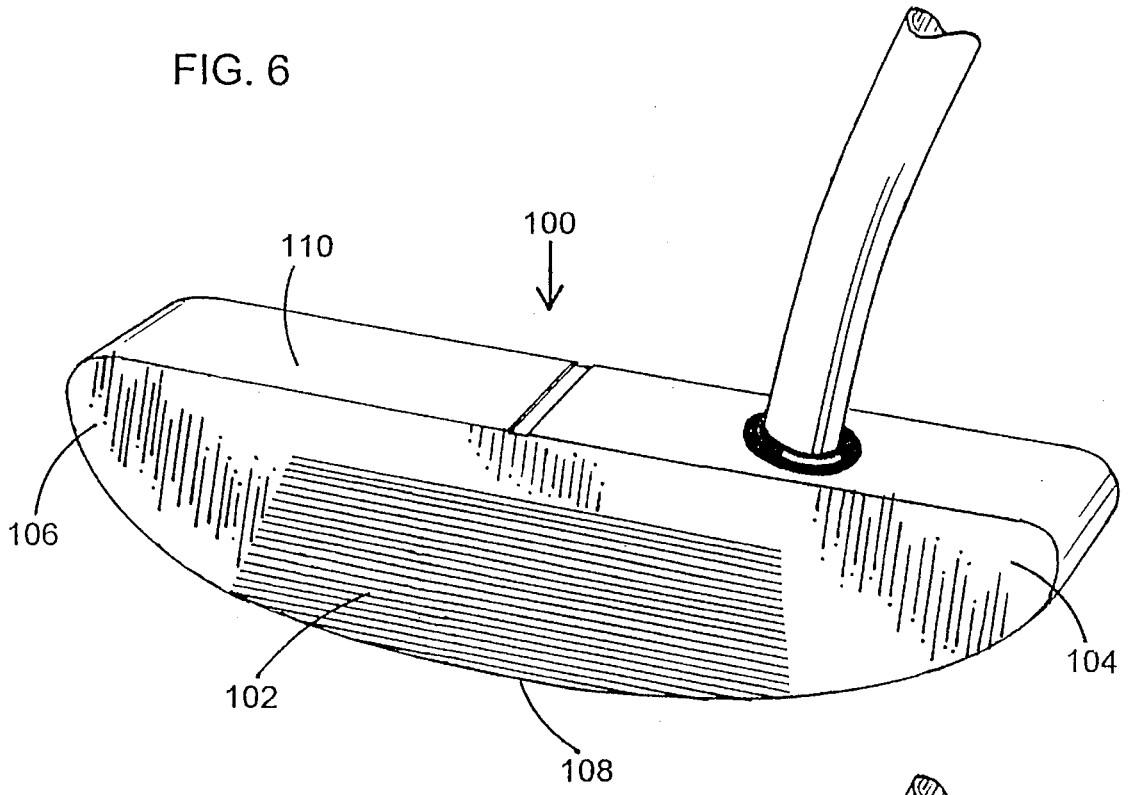
FIG. 6 is a front perspective view of a putter type golf club having an alternate groove pattern on the ball striking face.

FIG. 6 shows a putter type golf club head 100 having a groove configuration in accordance with the present invention formed in a pattern 102 which extends partway between the heel 104 and toe 106 and partway from the leading edge 108 to the top surface 110 of the club head 100.

Figure 7:
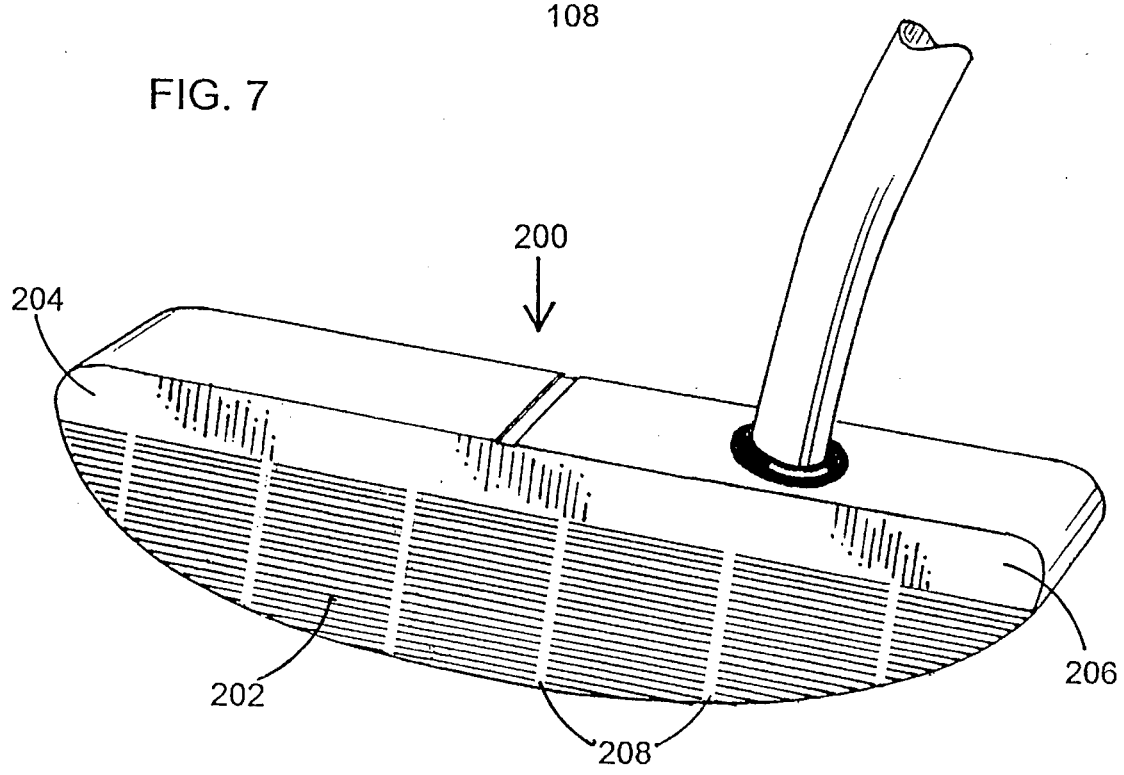
FIG. 7 is a front perspective view of still another putter type golf club having an alternate groove pattern on the ball striking face.

FIG. 7 shows another putter type golf club head 200 having a groove pattern 202 which extends the total distance between the toe 204 and heel 206. In this embodiment, the groove pattern 202 is formed with a series of vertical gaps 208 across the groove pattern 202.

Figure 8:
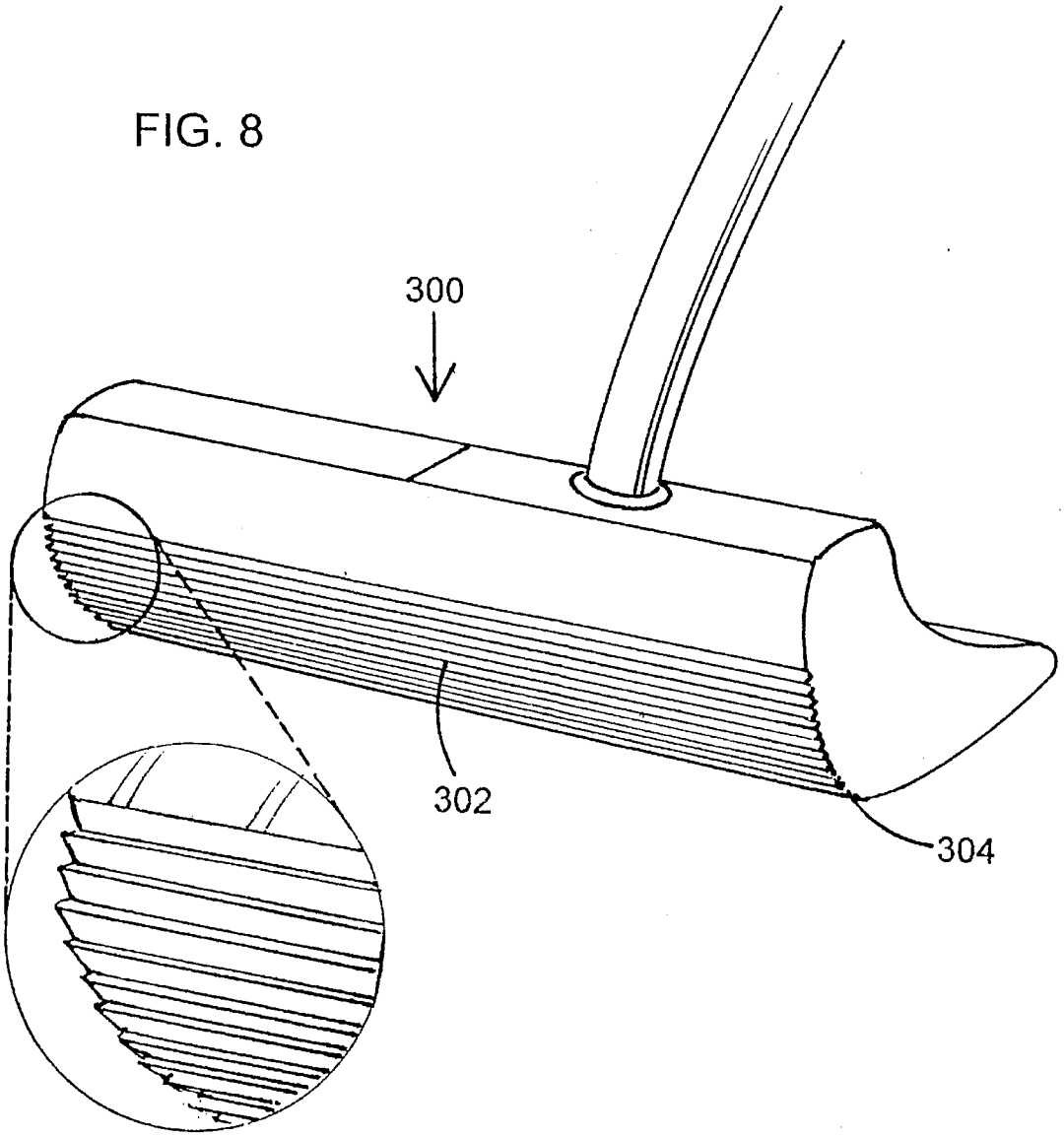
FIG. 8 is a front perspective view of yet another putter type golf club head of the present invention.

FIG. 8 shows a putter type golf club head 300 having a groove pattern 302 formed on a rounded ball striking face 304.

It will be appreciated that the length and angle of the groove surfaces may be varied slightly to create different spin characteristics of a golf ball when struck by putters using the groove pattern/configuration of the present invention. For example, a deeper or shallower groove may be made by increasing the angles of the groove surfaces.

While various preferred embodiments have been shown and described, it will be understood that there is no intent to limit the invention by such disclosure, but rather, is intended to cover all modifications and alternate constructions falling within the spirit and scope of the invention as defined in the appended claims.

I claim:

1. A putter type golf club head including a club head body with a heel, toe, upper surface, a bottom, ball striking face, said face being further defined by a flat plane coincident therewith, and a leading edge at the intersection of said ball striking face and said bottom wherein the improvement comprising:

a series of grooves formed in said ball striking face; each one of said grooves having a first surface at a first angle no greater than 90 degrees to said flat plane of said ball striking face and a second surface extending from an outermost portion of said first surface coincident with said flat plane; said second surface extending downwardly and inwardly from said ball striking face into said club head body, at an angle less than said first angle.

2. The putter type golf club of claim 1, wherein said grooves are each parallel to the others and said grooves extend in a heel to toe direction.

3. The putter type golf club of claim 1 wherein said first surface is perpendicular at an angle of 90 degrees to said ball striking face.

4. The putter type golf club of claim 2, wherein each of said grooves are adjacent to the others in a saw-tooth configuration.

5. The putter type golf club of claim 2, further including an intermediate flat area between each of said grooves wherein each of said grooves are spaced from the others.

6. The putter type golf club of claim 1, wherein said second surface of said grooves is angled at approximately thirty degrees with respect to said ball striking face.

7. The putter type golf club of claim 1, wherein said first surface of said grooves is at an angle less than 90 degrees and said second surface is at a second angle less than the angle of said first surface.

8. The putter type golf club of claim 7 wherein said angle of said first surface is approximately 60 degrees and said second angle of said second surface is approximately 30 degrees.

9. The putter type golf club of claim 1 wherein said grooves extend partway across the ball striking face in a heel to toe direction.

10. The putter type golf club of claim 1 wherein said grooves include gaps in the longitudinal direction.

11. The putter type golf club of claim 1 wherein said grooves extend the entire width across the ball striking face in a heel to toe direction.

12. The putter type golf club of claim 1 wherein said first surface and said second surface interface at the outermost location of said ball striking face to form a gripping area which engages a golf ball during the execution of a stroke by the putter type golf club.

13. The putter type golf club of claim 1 wherein said first surface is at an angle of 90 degrees with respect to the ball striking face and said second surface extends downwardly and inwardly from said ball striking face at an angle of approximately thirty degrees.

14. The putter type golf club of claim 12 wherein said interface of said first surface and said second surface is rounded.

15. The putter type golf club of claim 14 further including a second, rounded, inner interface of said first surface and said second surface at a bottom of said grooves.

* * * * *